United States Patent [19]

Salyer et al.

[11] 4,308,328

[45] Dec. 29, 1981

[54] UV-STABILIZED PHOTOGRAPHIC ELEMENTS

[75] Inventors: Ival O. Salyer; Arthur M. Usmani, both of Dayton, Ohio

[73] Assignee: Monsanto Company, St. Louis, Mo.

[21] Appl. No.: 160,532

[22] Filed: Jun. 18, 1980

Related U.S. Application Data

[62] Division of Ser. No. 33,780, Apr. 27, 1979, abandoned.

[51] Int. Cl.[3] ..... G03C 7/00

[52] U.S. Cl. ..... 430/17; 430/216; 430/372; 430/512; 430/551; 8/442

[58] Field of Search ..... 430/551, 372, 512, 17, 430/216; 8/92, 165, 442

[56] References Cited

U.S. PATENT DOCUMENTS

| | | | |
|---|---|---|---|
| 3,248,248 | 4/1966 | Coran et al. | 106/181 |
| 3,256,238 | 6/1966 | Anagnostopoulos et al. | 260/45.85 |
| 3,284,405 | 11/1966 | Coran | 260/45.85 |
| 3,893,805 | 7/1975 | Dellian et al. | 8/173 |
| 4,113,495 | 9/1978 | Shishido et al. | 96/100 |
| 4,159,910 | 7/1979 | Fujiwhara et al. | 96/74 |
| 4,228,235 | 10/1980 | Okonogi et al. | 430/551 |
| 4,252,893 | 2/1981 | Iwamuro et al. | 430/551 |

*Primary Examiner*—J. Travis Brown

*Attorney, Agent, or Firm*—George R. Beck

[57] ABSTRACT

Inclusion of a stabilizer selected from phenyl and naphthyl esters of benzene and naphthalene carboxylic acids and mixtures thereof in an article, e.g. a photographic element, comprising an organic dye or precursor thereof increases stability of the dye against ultraviolet radiation. Particularly good results are achieved when the stabilizer is dispersed in a polymer of relatively high solubility parameter and low crystallinity.

22 Claims, No Drawings

UV-STABILIZED PHOTOGRAPHIC ELEMENTS

This is a division of application Ser. No. 033,780, filed Apr. 27, 1979, now abandoned.

BACKGROUND OF THE INVENTION

It is known that most organic dyes are markedly unstable under the effects of ultraviolet (UV) radiation. This has significant undesirable consequences, including color fading and drift, in many articles of manufacture containing such dyes. In the photographic arts and other areas in which color fidelity is particularly important, the problems caused by effects of UV light on organic dyes, e.g. in film and/or prints prepared therefrom, are especially acute. For instance, at the time of film exposure in a camera, UV light can cause deterioration of sensitizing dyes involved in control of the visible light-induced silver halide reduction which forms the latent images for subsequent development. Thus, even in black-and-white photography, UV light has undesirable effects. In color photography, those effects of UV light can be significant, but are generally outweighed in importance by undesirable effects of UV light on image-forming dyes which color the finished print. Typical image-forming dyes tend to fade and/or change color substantially when subjected to substantial amounts of UV light, and when prints containing such dyes undergo prolonged exposure to UV light, very undesirable fading and/or drift of colors in the prints commonly results.

Much effort has been directed toward identification of substances which would stabilize organic dyes against UV light. For example, see U.S. Pat. Nos. 4,050,938 issued Sept. 27, 1977 and 4,042,394 issued Aug. 16, 1977 to W. F. Smith, Jr. et al, 4,045,229 issued Aug. 30, 1977 to W. W. Weber, II et al, 4,025,682 issued May 24, 1977 to R. F. W. Cieciuch et al and other references cited therein. Such efforts are complicated inasmuch as effectiveness of a given UV stabilizer varies considerably with the dyes to be stabilized and other characteristics of the articles containing those dyes; consequently it is very difficult to predict the degree of effectiveness of a given stabilizer or stabilizer candidate. Moreover, certain dyes are much more susceptible than others to undesirable effects of UV light. For example, the problems of color drift and fading are especially acute in articles containing azo dyes.

Accordingly, it is very desirable to identify substances which are more effective in stabilizing organic dyes against UV light, and it is an object of this invention to provide articles comprising an organic dye or precursor thereof and such a stabilizing substance. Another object is a method by which articles comprising an organic dye are efficiently stabilized against UV light. Another object is photographic elements which are stabilized against dye color deterioration by UV light. Another object is color photographic elements comprising organic dyes which are UV light-sensitive and a substance which is effective in stabilizing such dyes against UV light. Another object is azo dye-containing photographic prints having increased stability against UV light-induced color fading and/or drift. These and other objects will be further apparent from the following disclosure in which all parts and percentages are by weight except where otherwise noted.

SUMMARY OF THE INVENTION

By this invention, the aforedescribed objects are achieved by use of a stabilizer selected from phenyl and naphthyl esters of benzene and naphthalene carboxylic acids and mixtures thereof. Accordingly, in generic scope, the invention provides (1) a method for stabilizing an article containing an organic dye or precursor thereof against UV radiation by incorporating such a stabilizer in the article in amount and concentration sufficient to substantially increase the stability of the dye against UV radiation and (2) the resulting article comprising an organic dye or precursor thereof and such a stabilizer in such amount and concentration. Especially good results are obtained when the stabilizer is incorporated in the dye-containing article in a dispersion in a polymer having a relatively high solubility parameter and low crystallinity.

DETAILED DESCRIPTION OF THE INVENTION

The dye-containing articles which are stabilized in accordance with this invention are of many different kinds including, e.g. textile fibers and fabrics, wall coverings, extruded thermoplastic articles, art works such as paintings, etc., and photographic elements including unexposed film, exposed film and prints (including transparencies) prepared therefrom. Such photographic elements, which are typically comprised of a support having at least one coating including an organic dye or precursor thereof, are well known and comprehensively described in the literature, e.g. the aforementioned U.S. Pat. Nos. 4,050,938, 4,045,229, 4,025,682 and 4,042,394, "A Fundamentally New Imaging Technology for Instant Photography" by W. T. Hanson, Jr., 20 (4) Photo. Sci. and Eng. 155–60 (July/August 1976) and "Inside Color Photography" by J. R. Thirtle, CHEMTECH 25-35 (January 1979), the disclosures of which are incorporated herein by reference. Such photographic elements include those employed in black-and-white photography, color photography and especially instant (self-developing) color photography. The dyes or precursors thereof which are present in such photographic elements and stabilized in accordance with this invention include sensitizing dyes, image-forming dyes and precursors thereof such as, e.g. couplers, dye releasers, dye-developers (dyes attached to developing agents) and the like.

In specific embodiments of the invention, the color-stabilized organic dye is selected from the group consisting of azo, azomethine, azine, oxazine, anthraquinone, formazan, thiazine, cyanine, diphenylmethane, triphenylmethane, induline, indigoid, phthalein and pyronine dyes. Of particular utility are embodiments of this invention in which the dye is selected from the group consisting of azo, azine, azomethine, anthraquinone and formazan dyes. Mixtures and combinations of such dyes can likewise be stabilized in accordance with this invention. Particularly good results are achieved in stabilization of azo dyes, for instance (as described in the aforementioned article by Thirtle) ortho and para monoazo derivatives of enolic couplers such as, e.g. phenols, naphthols and pyrazolones. Specific examples of such dyes which are advantageously stabilized in accordance with this invention include arylazo-1-naphthols and arylazo-5-pyrazolones, and especially those in which the arylazo moiety is benzylazo. Structures of such exemplary dyes are depicted in the aforementioned articles by Hanson and Thirtle.

The stabilizers used in practice of this invention are selected from the group consisting of phenyl esters and naphthyl esters of benzene carboxylic acids and naphthalene carboxylic acids and mixtures of such esters. Thus such stabilizers include phenyl and naphthyl esters of monocarboxylic acids such as benzoic and naphthoic acids, e.g. phenyl naphthoates, naphthyl benzoates, naphthyl naphthoates, etc., dicarboxylic acids such as the phthalic acids and naphthalic acid, e.g. diphenyl and dinaphthyl phthalates, etc., and polycarboxylic acids such as trimellitic acid, e.g. triphenyl and trinaphthyl trimellitates. Preferred embodiments of such stabilizers include diphenyl, dinaphthyl and phenyl naphthyl esters of benzene and naphthalene dicarboxylic acids, especially isophthalic and terephthalic acids.

In any of such esters the aromatic rings may have additional substituents which do not interfere to prevent substantial attainment of objects of this invention. In fact, in many preferred embodiments of the invention, at least one aromatic ring in the stabilizer has one or more alkyl substituents having up to about 24 or more carbon atoms per alkyl substituent. Thus among the preferred diphenyl esters of isophthalic and terephthalic acids there may be advantageously used di(alkylphenyl) isophthalates and terephthalates in which each alkyl radical has up to about 24 carbon atoms, and preferably from about 4 to about 16 carbon atoms. Best results are usually obtained when the alkyl in such di(alkylphenyl) isophthalates and terephthalates has from about 8 to about 10 carbon atoms, especially when used in stabilization of the azo dyes mentioned hereinbefore. Highly preferred are those embodiments in which the stabilizer is di(nonylphenyl) isophthalate, terephthalate or a mixture thereof. In some instances, di(nonylphenyl) isophthalate is most preferred.

In any of such alkyl-substituted stabilizers, the alkyl can be straight-chain or branched (including tertiary). Good results are generally achieved when the alkyl is straight-chain or lightly branched, e.g. singly or doubly branched $C_8$–$C_{16}$ alkyl. It is also suitable to use compounds containing both straight-chain and branched alkyl substituents. Compounds in which at least one phenyl or naphthyl ring has more than one alkyl substituent are also suitable. A number of such compounds have been previously suggested for stabilization of polymeric substances, e.g. in U.S. Pat. Nos. 3,248,248 issued Apr. 26, 1966, 3,255,235 issued June 7, 1966, 3,256,238 issued June 14, 1966 and 3,284,220 and 3,284,405 issued Nov. 8, 1966 to C. E. Anagnostopoulos and A. Y. Coran, U.S. Pat. No. 3,080,339 issued Mar. 5, 1963 to D. A. Gordon and 14 Encyc. Poly. Sci. & Tech. 125–48, Interscience Publishers, New York, N.Y. (1971), the disclosures of which are incorporated herein by reference. Compounds containing the essential moieties of the aforementioned phenyl and naphthyl esters as a component of larger molecular structures are also suitable in many instances.

If desired, the stabilizer used in this invention can be combined (e.g. mixed) with the dye before or during incorporation of the dye in another article of manufacture and accordingly, an organic dye containing such a stabilizer constitutes an "article", as that term is used in disclosure and claiming of the invention herein. Otherwise, the stabilizer can be incorporated in a dye-containing article by various suitable techniques such as, for instance, mixing (e.g. with a dye-containing molten polymer) or application of a coating (ultimately internal or external) which need not contain the dye but which is situated such that it stabilizes the dye against UV radiation. Such a coating can be applied to the dye-containing article by any suitable procedure, e.g. dipping, knife-coating or spraying (usually advantageously at least twice to minimize discontinuities in the coating). For many uses, e.g. photographic elements, paintings, wall coverings, etc., it is commonly preferred that the coating be essentially transparent.

In a preferred embodiment, the stabilizer is dispersed (preferably uniformly) in a vehicle for incorporation in the dye-containing article. Generally best results are achieved when the vehicle comprises a polymer, and preferably a polymer which has sufficient chain length for good film-forming properties, e.g. an average chain length of at least about 1,000 atomic units such as carbon, oxygen, nitrogen, phosphorus, sulfur and/or other divalent or polyvalent atoms. Normally the maximum desirable number of such atomic units in the chain is about 100,000. It is also generally advantageous that the polymer be relatively polar, i.e., have a relatively high solubility parameter (square root of its cohesive energy density) of at least about 9. Also preferably the polymer employed is of relatively low crystallinity, e.g. not more than about 25% (and usually even more preferably not more than about 10%) crystalline as conventionally determined by x-ray diffraction.

Examples of polymers having such utility in this invention include many known polymers having a substantial proportion of pendant carboxy and/or hydroxy groups, for instance cellulosic and other polymeric esters (typically partially hydrolyzed) such as, e.g. polyvinyl acetate and cellulose esters of at least one $C_1$–$C_4$ saturated aliphatic monocarboxylic acid including cellulose acetate, acetate/propionate, acetate/butyrate, triacetate, etc., cellulose ethers, proteins such as, e.g. gelatin, polymethacrylates including polyhydroxymethacrylates, and mixtures of such polymers. Particularly good dye color stabilization in accordance with this invention is obtained using cellulose esters (especially cellulose acetate) as a vehicle for the stabilizer and, in addition, the aforementioned cellulose esters (especially cellulose acetate) are highly compatible with materials typically used in many dye-containing articles such as, e.g. photographic elements. Normally for best results, the stabilizer is suspended, dissolved or otherwise dispersed in the polymer-containing vehicle in a proportion which is minor (usually from about 1% to about 25% and, typically most advantageously, from about 5% to about 15%) with respect to the portion of the vehicle which remains when stability of the dye to UV radiation is most important.

For some modes of incorporation in the article containing a dye to be stabilized, the stabilizer and polymer as described herein can be initially dispersed in a solvent which facilitates such incorporation (e.g. by spraying, dipping or the like) and which is later at least partly removed, e.g. by evaporation. Preferably such a solvent is relatively polar, e.g. having a solubility parameter of at least about 9. Preferably for ease of removal, although not necessarily, the boiling point of the solvent is below 100° C. Examples of solvents suitable for this use include, e.g. tetrahydrofuran, acetone, methyl ethyl ketone, cyclohexanone, dimethyl formamide and dimethyl acetamide.

The following specific examples illustrate the invention but do not imply any limitations on its scope.

EXAMPLES I and II

Two overprint varnishes (OPV's) are made according to the following formulations:

| | Formula, % | |
|---|---|---|
| | OPV I | OPV II |
| Partially hydrolyzed cellulose acetate (40% acetyl content) | 13.0 | — |
| Tetrahydrofuran (THF) | 85.0 | 75.0 |
| Di(nonylphenyl) isophthalate* | 2.0 | 2.0 |
| Polymethyl methacrylate (coating grade) | — | 23.0 |
| | 100.0 | 100.0 |

*The alkyls are moderately branched but not tertiary.

Each varnish is prepared in a glass container in which the weighed ingredients are mixed and then shaken for 90 minutes to insure complete homogenization. The resulting solutions, which are optically clear and do not require filtration, are separately coated on approximately 7.5 cm×10 cm developed instant photographic color prints in which the image-forming dyes are essentially monoazo derivatives of enolic couplers, e.g. benzylazo-1-naphthols and benzylazo-5-pyrazolones. Each of the prints has been prepared identically by self-development of film exposed in photographing a display board on which were mounted eight 7.5 cm×10.3 cm color chips substantially spanning the visible spectrum using a commercially-available (Eastman Kodak Co.) instant color film. Each varnish is applied to a developed print in the same thickness between 0.025 and 0.05 mm by knife coating with a doctor blade, after which the THF is removed by evaporation. Using a third print not stabilized in accordance with this invention but otherwise identically prepared for comparative purposes, UV fading tests are carried out in a Sunlighter IV Ultraviolet Test Console (Test-Lab Apparatus Co., Amherst, N.H.) in which the prints are arranged on a flat, 43 cm-diameter turntable rotating 14 cm away from a single-bulb source of UV light (290–350 millimicron wave length range) of sufficient intensity that 24–48 hours of exposure simulate one year of exposure to natural sunlight in Florida. Air temperature inside the cabinet containing the turntable and UV light source is maintained at 60° C., and the prints are situated on the turntable such that each receives equal exposure to the UV light. At the end of 70 hours of continuous exposure of the prints, results are as shown in the following table which reports visually evaluated colors and fading coefficients. In the table, "fading coefficient" is the percent change from the specified original color in the print to a completely faded color (essentially white) which would be characterized by a 100% fading coefficient.

TABLE

| | Comparative Run (No stabilization in accordance with this invention.) | | OPV I (Cellulose Acetate Vehicle) | | OPV II (Polymethyl Methacrylate Vehicle) | |
|---|---|---|---|---|---|---|
| Original Color in Prints | Final Color | Fading Coefficient, % | Final Color | Fading Coefficient, % | Final Color | Fading Coefficient, % |
| Dark beige | Light ivory | 90 | No change | 5 | No change | 5 |
| Maroon | Light beige | 90 | No change | 10 | Slightly brownish maroon | 20 |
| Olive green | Light ivory | 80 | No change | 5 | No change | 10 |
| Dark rose | Light ivory | 90 | Medium rose | 15 | Orangy rose | 20 |
| Yellow | Light pale yellow | 95 | No change | 0 | No change | 0 |
| Dark red | Light ivory | 95 | Medium-dark red | 10 | Medium-dark red | 5 |
| Purple | White | 95 | No change | 10 | No change | 10 |
| Blue | Light brown | 80 | No change | 5 | No change | 5 |

The preceding examples illustrate that this invention provides an unexpectedly high degree of improvement in stability of a conventional kind of organic dyes against undesirable UV light effects such as color fading and color drift. Similar results are expected if the stabilizer is incorporated in an external or internal coating on photographic film prior to its exposure in a camera.

We claim:

1. A photographic element comprising a photographic organic dye image or precursor thereof and a stabilizer selected from phenyl and naphthyl diesters of benzene and naphthalene dicarboxylic acids and mixtures thereof in amount and concentration sufficient to substantially increase the stability of said dye against ultraviolet radiation.

2. A photographic element of claim 1 wherein said esters are di(alkylphenyl) isophthalates and terephthalates in which said alkyl has up to about 24 carbon atoms.

3. A photographic element of claim 2 wherein said stabilizer is dispersed in a film-forming polymer having a solubility parameter of at least about 9 and crystallinity not greater than about 25%.

4. A photographic element of claim 3 wherein said alkyl has from about 4 to 16 carbon atoms.

5. A photographic element of claim 4 wherein said polymer is selected from cellulose esters, cellulose ethers, proteins, polymethacrylates and mixtures thereof.

6. A photographic element of claim 5 wherein said alkyl has from about 8 to about 10 carbon atoms.

7. A photographic element of claim 6 wherein said polymer is predominantly cellulose ester.

8. A photographic element of claim 1 wherein said dye is an azo dye.

9. A photographic element of claim 1 wherein said dye is a monoazo dye derived from an enolic coupler selected from phenols, naphthols and pyrazolones.

10. A photographic element of claim 9 wherein said esters are di(alkylphenyl) isophthalates and terephthalates in which said alkyl has from about 4 to about 16 carbon atoms.

11. A photographic element of claim 1 wherein said dye is selected from arylazo-1-naphthols and arylazo-5-pyrazolones.

12. A method which comprises incorporating in a photographic element containing a photographic organic dye image or precursor thereof a stabilizer selected from phenyl and naphthyl diesters of benzene and naphthalene dicarboxylic acids and mixtures thereof in amount and concentration sufficient to substantially increase the stability of said dye against ultraviolet radiation.

13. A method of claim 12 wherein said esters are di(alkylphenyl) isophthalates and terephthalates in which said alkyl has from about 4 to about 16 carbon atoms.

14. A method of claim 13 wherein said dye is an azo dye.

15. A method of claim 13 wherein said stabilizer is dispersed in a film-forming polymer having a solubility parameter of at least about 9 and crystallinity not greater than about 25%, and the resulting stabilizer-containing polymer is incorporated in said element.

16. A photographic color print comprising a photographic organic dye image and a stabilizer selected from di(alkylphenyl) isophthalates and terephthalates and mixtures thereof in which said alkyl has from about 4 to about 16 carbon atoms in amount and concentration sufficient to substantially increase the stability of said dye against ultraviolet radiation.

17. A photographic color print of claim 16 wherein said stabilizer is dispersed in a film-forming polymer having a solubility parameter of at least about 9 and crystallinity not greater than about 25%.

18. A photographic color print of claim 16 having a coating containing said stabilizer dispersed in a film-forming polymer having a solubility parameter of at least about 9 and crystallinity not greater than about 25%.

19. A photographic color print of claim 18 wherein said polymer is selected from cellulose esters, polymethacrylates and mixtures thereof.

20. A photographic color print of claim 18 wherein said dye or precursor thereof is not contained in said coating.

21. A photographic color print of claim 20 wherein said dye is an azo dye.

22. A photographic color print of claim 20 wherein said coating is an external coating on said print.

* * * * *